US008002446B1

(12) United States Patent
Plunk et al.

(10) Patent No.: US 8,002,446 B1
(45) Date of Patent: Aug. 23, 2011

(54) VIRTUAL DIRECT AND INDIRECT SUSPENDED LIGHTING FIXTURE

(75) Inventors: Carlton Plunk, Saltillo, MS (US); Eugene Graff, Tupelo, MS (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 146 days.

(21) Appl. No.: 12/259,323

(22) Filed: Oct. 28, 2008

Related U.S. Application Data

(60) Provisional application No. 61/059,939, filed on Jun. 9, 2008.

(51) Int. Cl.
*F21V 17/00* (2006.01)

(52) U.S. Cl. ..... 362/364; 362/365; 362/366

(58) Field of Classification Search ..... 362/364, 362/365, 366
See application file for complete search history.

(56) References Cited

U.S. PATENT DOCUMENTS

| | | | | | |
|---|---|---|---|---|---|
| 2,556,690 | A | * | 6/1951 | Guth | 362/225 |
| 2,623,160 | A | | 12/1952 | Mcphail | |
| 2,675,466 | A | | 4/1954 | Baker | |
| 2,755,374 | A | | 7/1956 | Ott | |
| 4,161,767 | A | | 7/1979 | Benasutti | |
| 4,204,274 | A | | 5/1980 | Luderitz | |
| 4,263,639 | A | * | 4/1981 | Schacht | 362/147 |
| 4,277,820 | A | | 7/1981 | Bostonian | |
| 4,295,186 | A | | 10/1981 | Sugiura | |
| 4,388,675 | A | | 6/1983 | Lewin | |
| 4,415,957 | A | | 11/1983 | Schwartz | |
| 4,418,378 | A | | 11/1983 | Johnson | |
| 4,425,604 | A | | 1/1984 | Imai | |
| 4,517,631 | A | | 5/1985 | Mullins | |
| 4,625,267 | A | | 11/1986 | Mikalonis | |
| 4,630,181 | A | | 12/1986 | Fain | |
| 4,747,027 | A | | 5/1988 | Rieger | |
| 4,748,547 | A | | 5/1988 | Baker | |
| 4,760,505 | A | | 7/1988 | Cole | |
| 4,796,168 | A | | 1/1989 | Peterson | |
| 4,849,864 | A | | 7/1989 | Forrest | |
| 4,876,633 | A | | 10/1989 | Engel | |
| 4,928,209 | A | | 5/1990 | Rodin | |
| 4,933,820 | A | | 6/1990 | Engel | |
| 4,939,627 | A | | 7/1990 | Herst | |
| 4,974,137 | A | | 11/1990 | Evans | |
| 4,975,812 | A | | 12/1990 | Cole | |
| 4,980,808 | A | | 12/1990 | Lilos | |
| 5,038,254 | A | | 8/1991 | Fabbri | |
| 5,075,827 | A | | 12/1991 | Smith | |
| 5,086,375 | A | | 2/1992 | Fabbri | |
| 5,160,193 | A | | 11/1992 | Fabbri | |
| 5,199,786 | A | | 4/1993 | Baliozian | |
| 5,272,607 | A | | 12/1993 | Grimm | |
| 5,272,608 | A | | 12/1993 | Engle | |
| 5,289,357 | A | | 2/1994 | Fabbri | |
| 5,343,373 | A | | 8/1994 | Tillotson | |
| 5,521,801 | A | | 5/1996 | Pesau | |
| 5,526,237 | A | | 6/1996 | Davenport | |
| 5,526,244 | A | | 6/1996 | Bishop | |

(Continued)

*Primary Examiner* — Sandra L O Shea
*Assistant Examiner* — Danielle Allen

(57) ABSTRACT

A direct and indirect suspended component light fixture is described herein. The light engine of the fixture is recessed within a ceiling and contains a plurality of linear fluorescent lamps substantially surrounded by an ellipsoidal reflector. The ellipsoidal reflector reflect light downward through a light output region to a suspended diffuser, the suspended diffuser acting as both a provider of direct and indirect light to generate smooth and even illumination both in the indirect and direct light components.

14 Claims, 2 Drawing Sheets

U.S. PATENT DOCUMENTS

| | | | | | |
|---|---|---|---|---|---|
| 5,658,067 | A | | 8/1997 | Engle | |
| 5,685,633 | A | | 11/1997 | Engel | |
| 5,709,460 | A | * | 1/1998 | Lester | 362/147 |
| 5,727,870 | A | | 3/1998 | Grierson | |
| 5,743,627 | A | | 4/1998 | Casteel | |
| 5,806,972 | A | | 9/1998 | Kaiser | |
| 5,823,656 | A | | 10/1998 | Waldmann | |
| 5,865,528 | A | | 2/1999 | Compton | |
| 5,884,993 | A | | 3/1999 | Conn | |
| 5,884,994 | A | | 3/1999 | Herst | |
| 5,921,666 | A | | 7/1999 | Preston | |
| 5,988,829 | A | * | 11/1999 | Holder | 362/223 |
| 5,988,836 | A | * | 11/1999 | Swarens | 362/364 |
| 6,042,246 | A | | 3/2000 | Waldmann | |
| 6,053,624 | A | | 4/2000 | Cronk | |
| 6,174,069 | B1 | | 1/2001 | Plunk | |
| 6,247,828 | B1 | | 6/2001 | Herst | |
| 6,402,345 | B1 | | 6/2002 | Fishman | |
| D463,058 | S | | 9/2002 | Nourishad | |
| 6,505,953 | B1 | | 1/2003 | Dahlen | |
| 6,572,246 | B1 | | 6/2003 | Hopp | |
| 6,655,819 | B2 | | 12/2003 | Loga et al. | |
| 6,776,509 | B1 | | 8/2004 | Warner | |
| 6,837,592 | B1 | | 1/2005 | Dahlen | |
| 6,843,586 | B1 | * | 1/2005 | Allaire | 362/298 |
| 7,048,416 | B2 | | 5/2006 | Clark | |
| 7,090,379 | B2 | | 8/2006 | Targetti | |
| 7,121,690 | B1 | | 10/2006 | Ramer | |
| 7,229,191 | B1 | | 6/2007 | Plunk | |
| 7,284,883 | B2 | | 10/2007 | Clark | |
| 2004/0095771 | A1 | | 5/2004 | McDonald | |

* cited by examiner

VIRTUAL DIRECT AND INDIRECT SUSPENDED LIGHTING FIXTURE

CROSS-REFERENCE TO RELATED APPLICATION

This nonprovisional patent application under 35 USC §119 (e) claims priority to, and benefit from, U.S. Provisional Application Ser. No. 61/059,939, filed on Jun. 9, 2008, entitled "Virtual Direct and Indirect Suspended Lighting Fixture," which is currently pending naming the above-listed individuals as joint inventors.

FIELD OF THE INVENTION

The present invention is directed towards a direct and indirect suspended component light fixture wherein a main light engine compartment is recessed within the ceiling and utilized in combination with a suspended diffuser acting as a reflector and refractor for providing both direct down light and indirect light illuminating the ceiling all while maintaining smooth and even illumination throughout the room.

BRIEF DESCRIPTION OF THE DRAWINGS

The present invention is detailed and exemplified in the attached drawings setting forth exemplary construction of the various elements claimed. These figures include:

DETAILED DESCRIPTION OF THE PREFERRED EMBODIMENT

Figure 1:
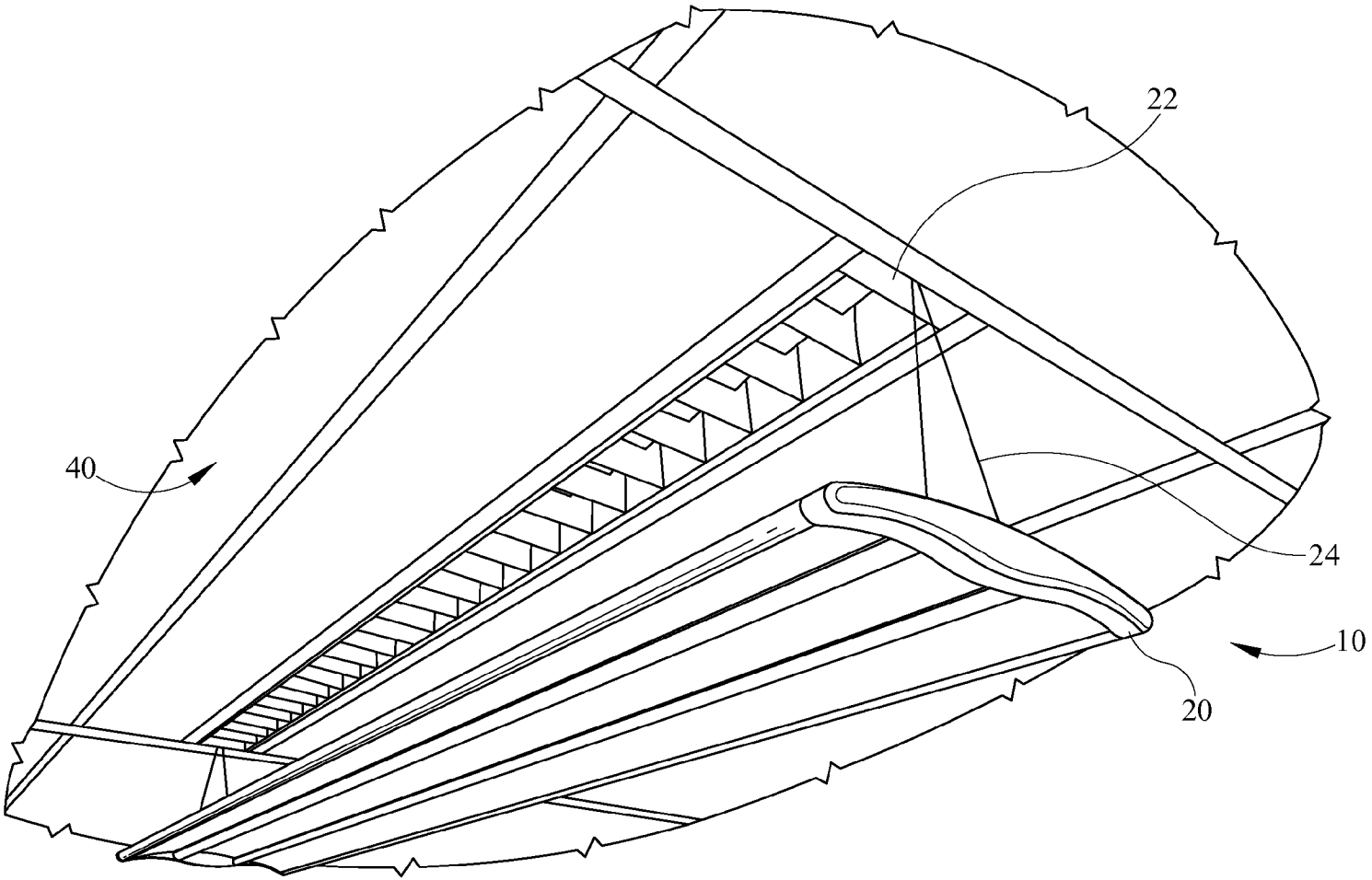
FIG. 1 is a lower perspective view detailing the light fixture of the present invention with the reflector and refractor suspended below the primary light engine.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," "in communication with" and "mounted," and variations thereof herein are used broadly and encompass direct and indirect connections, couplings, and mountings. In addition, the terms "connected" and "coupled" and variations thereof are not restricted to physical or mechanical connections or couplings.

Furthermore, and as described in subsequent paragraphs, the specific mechanical configurations illustrated in the drawings are intended to exemplify embodiments of the invention and that other alternative mechanical configurations are possible.

In providing direct and indirect suspended component light fixtures, typical suspended architecture is required wherein indirect light is provided upward toward the ceiling, the indirect light originating from a light engine in the suspended component thereby requiring electrical cabling and control lines from the ceiling to the suspended component. Additionally, such designs provide hot spot lighting wherein certain indirect areas on the ceiling are illuminated at a higher incident rate as compared to others. It is therefore desirous to provide even illumination in both the indirect and direct components for a light fixture without providing such hot spots. It is also desirous to provide such indirect reflective light without unsightly cabling exposed to view.

The presently described direct and indirect suspended component light fixture provides even illumination by utilizing an ellipsoidal or ovalized reflector maintained or recessed within the ceiling and out of view, but designed for use with a reflector to create a virtual lamp or focal point below the ceiling line and above the reflector and refractor suspended component 20.

Figure 2:
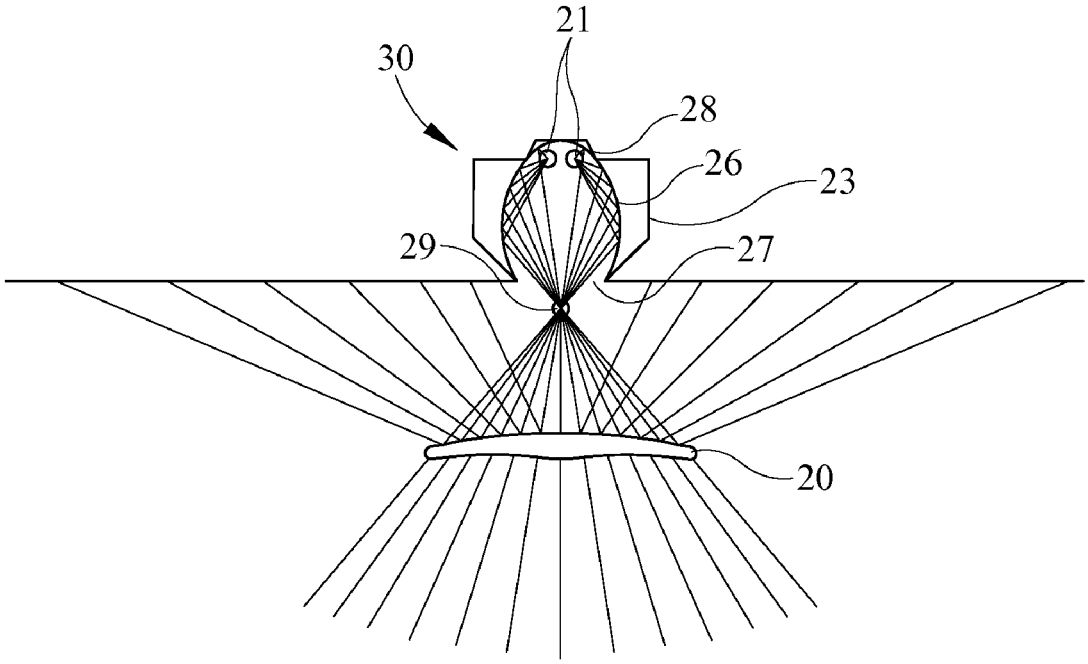
FIG. 2 is the side sectional view of the direct and indirect suspended component light fixture of the present invention detailing the light engine and suspended diffuser.

The indirect and direct suspended component light fixture 10 described herein and shown in FIG. 1 and FIG. 2 provides a linearly extending lamp housing 28 fitted within a troffer 23 all of which is suspended in the ceiling. The entire light engine 30 as shown in the figures is recessed above the ceiling plane and incorporates utilization of one or more high efficiency fluorescent lamps 21, as shown in the present examples, or other known light sources. The light engine 30 disclosed herein utilizes a reflector 26 substantially surrounding the lamps 21 along the entire axial length of the lamp housing 28 and interior to the troffer housing 23 as shown. The ovalized or ellipsoidal reflector 26 has an opening at a lower region forming a light output region 27 below the lamps allowing the light created by the lamps 21 to be output to a focal point creating a virtual lamp 29 below the ceiling line and above the suspended reflector and refractor 20.

Linearly extending along the light output region 27 of the troffer housing 23 may be a linear baffle 22 which enables hiding of the longitudinal view of the lamps 21 retained within the lamp housing 28. Thus, due to linear baffles 22, direct view of the high output lamps 21 may be blocked, particularly at an angle, due to the plurality of baffle blades extending downward from the area inside the troffer housing and reflector 23, 26 towards the light output region 27 as is necessary and desired.

The entire light fixture 10 may be retained and recessed within the ceiling line 40 as shown in FIG. 1 and FIG. 2, the ceiling plane may be a suspended ceiling, fixed ceiling or other known areas in which light fixtures may be installed. As shown in FIG. 1, ceiling grid numbers may be employed to support the fixtures structure as they are known in the art, the ceiling grid being 2×4, 2×8 or longer as is necessary and as designed.

High efficiency lamps 21 placed linearly along the interior of the reflector 26 produce light output to a focal point or a virtual lamp 29 position directly below the ceiling plane 40, the focal point 29 below the light output region 27 of the reflector 26 but above the diffuser 20, the diffuser acting as both a reflector and a refractor to provide various components of light in both a direct and indirect manner. The virtual lamp position below the ceiling plane may be moved dependent upon the type of ellipsoidal reflector 26 implemented and desired and as such the virtual lamp position may be raised or lowered to accommodate different sizes and shapes of the suspended component 20 of the light fixture presently described herein.

By utilization of the various designs set forth, the lamps and ballasts may be maintained and recessed within the ceiling thereby hiding them from view and removing any unnecessary or unsightly wiring above the ceiling plane. The creation of the virtual lamp 29 below the ceiling plane 40 and below the troffer housing 23 and reflector 26 is such that the suspended element 20 may be suspended close to the ceiling line without creating the known hot spot areas on the ceiling.

These hot spots are known in traditional suspended indirect light fixtures and thus the virtual lamp position set forth herein allows tight correlation, as described herein, of approximately five to nine inches, between the suspended diffuser and the light output region 27 and ceiling plane 40. As shown in the figures, the light output region 27 of the reflector and ceiling plane 40 are in corresponding relationship. However, both may be separated appropriately as is necessary and as may be designed such that the light output region may be behind the ceiling plane as installed, the light engine installed higher than the exemplary figures disclosed. Additionally, the suspended diffuser 20, acting as both a reflector and a refractor in the present embodiment, may be anywhere from five to nine inches away from the ceiling and preferably may be approximately seven inches away from the ceiling line or lower edge of the reflector 26. Positioning of the reflector and refractor suspended component 20 may be made depending on the desirable light configuration within the room thereby increasing or decreasing both the indirect and direct components. Such modification may also be implemented through the utilization of various types of diffusers 20 thereby increasing the reflector properties thereof to create more indirect light and ceiling illumination and less direct down light from the suspended component 20. Alternatively, it may be desirous to provide more down light and reduce the reflective uplight due to various required illumination properties. Such may be implemented through the utilization of various known reflector and refractor properties within the suspended component 20 as is desirous and known to one of ordinary skill in the art.

The suspended baffle 20 may be suspended through the utilization of wires, cables, or other known suspension mechanisms 24 as are known in the art, the suspension mechanisms suspending either end of the suspended component 20 and affixed to a portion of the troffer housing 23 as is necessary. Alternatively, the suspension mechanisms 24 may be suspended and attached to the T-bar grid support frame. Many known suspension mechanisms may be utilized for implementation of the ellipsoidal reflector 26 and suspended reflector and refractor components set forth herein and the exemplary embodiments depicted within the figures is not to be deemed limiting. Standard known ballasts may be utilized for conjunction with the high efficiency lamps 21 shown herein. Additionally, reflector 26 may be any known ellipsoidal shaped reflector made of highly reflective material and designed and constructed such that a focal point of light is generated below the ceiling plane outside the area defined by the light engine and lamp housing 30, 28. Known reflectors may be utilized as are necessary and implemented as needed including aluminum, anodized and other similar type reflectors. The plurality of longitudinally extending lamps 21 may be placed in side-by-side relationship as shown in the exemplary example of FIG. 2, as well as in end-to-end relationship in order to increase the overall longitudinal length of the fixture 10. Installation may occur above the ceiling line with known junction box and wiring techniques such that adequate line voltage is provided through the junction box to the ballasts which are not shown, but which typically are required for high efficiency fluorescent lamps. Various other known lamps or light illumination structures such as LED and incandescent lamps, among others, may be implemented and utilized in conjunction with the separate suspended reflector and refractor 20. The diffuser acting as the reflector and refractor is designed to be placed a sufficient distance away from the focal point 29 so desirous illumination is met producing dual components of light, downlight direct and indirect uplight to the ceiling. Both components, as previously discussed, may be modified utilizing materials having increased or decreased reflective and refractive properties in order to correspondingly increase or decrease indirect uplight or direct downlight through the diffuser. Such modifications to a suspended reflector and refractor may be readily implemented depending upon the desirable lighting characteristics. Such use of the suspended component 20 in combination with the virtual lamp or focal point 29 position below the ceiling plane provides adequate illumination properties and characteristics as described herein to provide tight correlation between the diffuser 20 and the lower portion of the reflector 26, lightout 27 and ceiling plane 40 without the unsightly cabling or other electronic connectivity between the suspended component and an indirect lighting known heretofore.

The foregoing description of structures and methods has been presented for purposes of illustration. It is not intended to be exhaustive or to limit the invention to the precise steps and/or forms disclosed, and obviously many modifications and variations are possible in light of the above teaching. It is understood that while certain forms of the low pressure forced air heater have been illustrated and described, it is not limited thereto except insofar as such limitations are included in the following claims and allowable functional equivalents thereof.

What is claimed is:

1. A direct and indirect suspended component light fixture, comprising:

a recessed light engine having a longitudinally extending linear light source substantially surrounded by an ellipsoidal reflector, said ellipsoidal reflector redirecting light from said light source to a focal point outside said light engine below a ceiling line and above a reflector and refractor diffuser thereby creating a vertical lamp below said ellipsoidal reflector;

wherein said light engine is designed to be installed recessed within a ceiling;

said reflector and refractor diffuser suspended below said light engine and said focal point wherein said reflector and refractor diffuser is designed to provide both direct illumination below said fixture and indirect light to be reflected to said ceiling.

2. The direct and indirect suspended component light fixture of claim 1 wherein said reflector in said light engine has a substantially ovalized cross-section around said light source with an open lower section forming a light output region.

3. The direct and indirect suspended component light fixture of claim 2 wherein said light engine reflector is surrounded by a fixture troffer housing to be installed in a ceiling.

4. The direct and indirect suspended component light fixture of claim 2 wherein said reflector and refractor is suspended from said fixture below said light output region and said focal point by a plurality of hanging support members.

5. The direct and indirect suspended component light fixture of claim 4 wherein said reflector and refractor is suspended from about five inches to about nine inches below said light output region.

6. The direct and indirect suspended component light fixture of claim 5 wherein said reflector and refractor is suspended at about seven inches below said light output region.

7. The direct and indirect suspended component light fixture of claim 5 wherein said light output region is along the same plane defined by a ceiling into which said recess light engine is installed.

8. The direct and indirect suspended component light fixture of claim 2 wherein said light output region further has a linear baffle designed to hide the longitudinal view of said light source.

9. The direct and indirect suspended component light fixture of claim 1 wherein said light source of said fixture is a linear fluorescent lamp.

10. The direct and indirect suspended component light fixture of claim 9 wherein said linear fluorescent lamp is a plurality of high efficiency linear fluorescent lamps.

11. The direct and indirect suspended component light fixture of claim 10 wherein said plurality of lamps are T-5 or T-8 high efficiency fluorescent lamps.

12. The direct and indirect suspended component light fixture of claim 1 wherein said reflector of said light engine is said ellipsoidal reflector recessed within said ceiling and reflecting light from said linear light source though a light exit aperture to said focal point, said focal point creating a virtual lamp outside of said light engine.

13. The direct and indirect suspended component light fixture, comprising:

a light engine designed to be recessed behind a ceiling and having a longitudinally extending linear light source substantially surrounded by an ellipsoidal reflector, said ellipsoidal reflector reflecting light to a focal point below said light housing and through a light output region;

a reflector and refractor diffuser suspended below said light engine and said focal point providing both direct and indirect illumination to an area below said fixture by both transmitting light and reflecting light;

wherein said reflector and refractor diffuser is suspended below said light engine from about five inches to about nine inches;

wherein said focal point creates a virtual lamp outside of said ellipsoidal reflector and above said diffuser;

said light engine further including a linear baffle having a plurality of plates extending and portioned along said light output region to obscure the longitudinal view of said longitudinally extending linear light source.

14. The direct and indirect suspended component light fixture, comprising:

a recessed light engine, said recessed light engine positioned within a ceiling and configured to directly light through a light output region, said recessed light engine creating a virtual lamp directly below said light output region of said recessed light engine;

an ellipsoidal reflector retained within said recessed light engine and substantially surrounding a longitudinally extending light source, said ellipsoidal reflector having a opening forming said light output region of said recessed light engine;

wherein said virtual lamp is formed by a focal point created by the curvature of said ellipsoidal reflector relative to said light source, said focal point positioned below said recessed light engine between said opening of said reflector and above a reflector and refractor diffuser;

said reflector and refractor diffuser longitudinally suspended below said ellipsoidal reflector and optimized to both reflect light to said ceiling and thereby create indirect light and transmit light to create diffuse direct light through said diffuser.

* * * * *